US005156393A

United States Patent [19]

Erkisson

[11] Patent Number: 5,156,393

[45] Date of Patent: Oct. 20, 1992

[54] INFEED ARRANGEMENT

[75] Inventor: Anders Erkisson, Bromma, Sweden

[73] Assignee: Sapia Mekatronik AB, Solna, Sweden

[21] Appl. No.: 668,505

[22] PCT Filed: Sep. 28, 1989

[86] PCT No.: PCT/SE89/00529

§ 371 Date: Mar. 28, 1991

§ 102(e) Date: Mar. 28, 1991

[87] PCT Pub. No.: WO90/03325

PCT Pub. Date: Apr. 5, 1990

[30] Foreign Application Priority Data

Sep. 30, 1988 [SE] Sweden ..... 8803491

[51] Int. Cl.[5] ..... B65H 29/20

[52] U.S. Cl. ..... 271/315

[58] Field of Search ..... 271/315, 204–206, 271/198, 187, 307

[56] References Cited

U.S. PATENT DOCUMENTS

| | | | |
|---|---|---|---|
| 1,920,715 | 8/1933 | Sager | 271/79 |
| 3,266,796 | 8/1966 | Haney et al. | 271/45 |
| 3,915,447 | 10/1975 | Perno | 271/7 |
| 4,026,199 | 5/1977 | Adams et al. | 93/36 A |
| 4,647,032 | 3/1987 | Oba | 271/315 X |

FOREIGN PATENT DOCUMENTS

| | | | |
|---|---|---|---|
| 2104440 | 9/1972 | Fed. Rep. of Germany . | |
| 3735815 | 2/1989 | Fed. Rep. of Germany . | |
| 59-203051 | 11/1984 | Japan . | |
| 114959 | 6/1986 | Japan | 271/204 |
| 1174457 | 12/1969 | United Kingdom . | |
| 2011866 | 7/1979 | United Kingdom . | |

*Primary Examiner*—David H. Bollinger
*Attorney, Agent, or Firm*—Nies, Kurz, Bergert & Tamburro

[57] ABSTRACT

An infeed arrangement for feeding sheet-like objects, primarily banknotes, into a space in which the objects are stacked, one upon the other, and to which the objects are fed through an infeed aperture from an external location. The invention is characterised in that the infeed arrangement comprises an infeed path (1) which includes at least one endless belt (2) which is arranged to move past the infeed aperture (5, 7). The infeed path (1) includes a flat part (11) beneath which an object (12) fed into the arrangement is intended to be deposited. The path (1) includes downstream of the flat part (11) a curved part where the path turns back towards the infeed aperture (5, 7). The belt (1) is provided with at least one flap (20; 21) or like element which extends rearwardly in the transport direction and the forward edge of which, seen in the transport direction (3), projects from the outwardly facing side of the belt (2), the flap (20; 21) having a length dimension in the transport direction which is shorter than the length of the object (12). The object is intended to be inserted into the infeed aperture (5), with the forward edge of the object, as seen in the transport direction, positioned between the flap (20, 21) and the belt (2). The curved part of the infeed path is configured so that the rear edge of the flap will swing away from the belt, when the rear edge of the flap leaves the flat part of the infeed path. The arrangement functions to draw the object forward by its forward edge.

20 Claims, 2 Drawing Sheets

INFEED ARRANGEMENT

The present invention relates to an infeed arrangement, primarily intended for feeding banknotes into a banknote collecting space.

BACKGROUND OF THE INVENTION

Cassettes into which banknotes are fed for storage purposes are becoming more and more usual.

One type of banknote storage cassette is constructed to prevent unauthorized removal of the banknotes therefrom and is provided with means operative to destroy the banknotes in the cassette by coating the banknotes with a dye, or rendering the banknotes useless in some other way, should an attempt be made to forceably feed-out the banknotes or to destroy the cassette.

Other types of cassette are also known to the art. Irrespective of the type of cassette used, or whether other forms of banknote-storage devices are used, one problem common to all such devices resides in the inability of feeding large quantities of banknotes into the banknote-storage device and stacking the banknotes therein in a smooth and trouble-free fashion.

Interruptions in the infeed of banknotes into devices of this nature are inter alia, primarily due to jamming of a banknote so as to block the infeed path of the next banknote in line.

Such crinkling of a banknote, i.e. folding and pleating of a banknote as it is fed in to the banknote storage device, is normally caused because the banknote to be fed into the device, or the uppermost banknote of a stack of banknotes, has along one edge thereof a tear which extends parallel with the transport direction or the leading edge of the banknote. This crinkling of a banknote is more liable to occur when the tear is located close to the end of the first banknote to be fed into the device.

In the case of known banknote infeed mechanisms, a banknote is normally introduced into a banknote magazine between a pair of rubber drive-rollers. Such mechanisms operate by inserting the uppermost or lowermost banknote of a stack of banknotes into the magazine. This known technique is unsatisfactory, when the banknotes concerned are worn, and particularly when the banknotes are damaged. When one or more banknotes crinkle in the afore-defined fashion, the cassette cannot be used again until it has been emptied of banknotes. This magazine-emptying procedure requires the use of special devices, however, such as electronic devices, in order to enable the cassette to be opened without destroying the banknotes. These devices are not normally kept in the place or premises where the cassette is used, but in some other place.

SUMMARY OF THE INVENTION

The present invention avoids the disadvantage of known banknote infeed mechanisms with regard to the faulty functioning and deficiency of such devices when the banknotes to be fed in to banknote magazines with the aid of such mechanisms are worn and damaged.

This drawback is avoided by means of the present invention because the inventive infeed arrangement operates in accordance with a totally different principle.

Although reference has been made hitherto solely to banknotes, it will be understood that the present invention can also be applied to the infeed of tickets, betting coupons of various kinds, raffle tickets and other valuable documents.

Thus, the invention is not restricted to a banknote infeed arrangement, but can be applied to all sheet-like objects.

The present invention thus relates to an arrangement for feeding sheet-like objects, primarily banknotes, into a space in which the objects are stacked one upon the other and with which the objects are fed externally through an infeed aperture into said space. The arrangement is characterised in that it includes an infeed path which comprises at least one endless belt which is arranged to move past the infeed aperture; in that the path includes a flat part beneath which an object is intended to be deposited; in that the path includes downstream of said flat part a curved part where said path turns back towards the infeed opening; in that the belt is provided with at least one flap or corresponding element which faces rearwardly in the transport direction and the forward edge of which, as seen in said transport direction, projects outwardly from the outwardly facing side of the belt, said flap having in the transport direction a length extension which is shorter than the length extension of an object, said object being intended to be inserted into the infeed aperture and positioned so that its leading edge is located between the flap and the belt; and in that the curved part of said belt is configured so that the rear edge of the flap will swing out from the belt when the rear edge of said flap leaves the flat belt part.

BRIEF DESCRIPTION OF THE DRAWING

The invention will now be described in more detail with reference to exemplifying embodiments of the invention and with reference to the accompanying drawings, in which.

DESCRIPTION OF THE PREFERRED EMBODIMENTS

Figure 1:
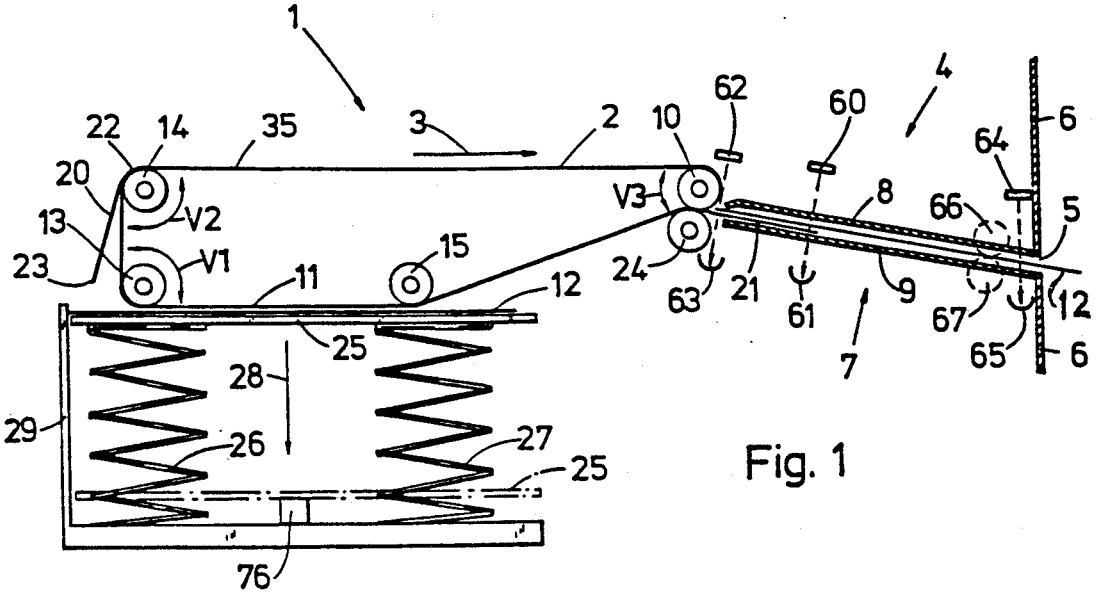
FIG. 1 illustrates schematically and in side view a first embodiment of an arrangement according to the invention.

FIG. 1 illustrates schematically and in side view a first embodiment of an infeed arrangement constructed in accordance with a first embodiment. The inventive arrangement comprises the actual infeed mechanism together with some kind of sheet-collecting device, where the sheets are stacked one upon the other. The sheet-collecting device may be of any kind capable of coacting with the infeed mechanism.

As before mentioned, the present invention relates to an infeed arrangement for sheet-like objects. The invention is described hereinafter, however, with reference to banknotes as an example of such sheet-like objects.

FIG. 1 illustrates the arrangement schematically, for the sake of clarity.

The infeed arrangement includes an infeed path 1 which comprises at least one endless belt 2 which is intended to move in the direction shown by the arrow 3. The belt 2 passes an infeed aperture, generally referenced 4.

The infeed aperture includes a slot-like opening 5 provided in a casing 6 or the like surrounding the arrangement, and an infeed passage 7 which leads to the belt 2.

Guide plates 8, 9 or like elements are preferably provided along the infeed passage 7, in order to ensure that a banknote inserted through the slot 5 will be positioned correctly in relation to the belt.

In the location of the infeed aperture 4, the belt 2 runs over a first guide-roller assembly 10, which may comprise two or more mutually parallel guide rollers.

The infeed path 1 includes a flat part 11 beneath which the banknotes 12 fed into the arrangement are intended to be deposited and there stacked, where the banknote or object last inserted will lie on the top of the stack illustrated in FIG. 1. Downstream of the flat part 11, the path presents a curved part, where the path 1 passes over a second guide-roller 13 and forms an angle V1 with the flat part 11 of said path, whereafter the path 1 runs over a third belt guide-roller 14 located at a distance from the second belt guide-roller 13 in a direction towards the infeed aperture.

The embodiment illustrated in FIG. 1 also includes a fourth guide-roller 15.

The infeed path, or belt, is driven by an electric motor connected to the shaft of one of the guide-rollers 10, 13–15.

The belt 2 is provided with at least one flap 20, 21 which projects outwardly in the transport direction. In the case of the FIG. 1 embodiment, the belt is provided with two flaps 20, 21 which are spaced apart by a distance corresponding to half the circumference of the belt.

The forward edge 22 of each of the flaps 20, 21, as seen in the transport direction 3, projects so the respective flap is offset outwards from the outwardly facing side of the belt 2.

The length dimension of the flaps 20, 21 is shorter than the length dimension of a banknote in the transport direction. According to one preferred embodiment, the flap 20, 21 has a length dimension which is shorter than half the length of the banknote, preferably shorter than a third of the length dimension of a banknote.

The infeed of a banknote is commenced by inserting the banknote into the infeed aperture and therewith positioning the banknote so that its forward edge, seen in the transport direction, is placed between the flap 21 and the belt 2, as illustrated in FIG. 1.

The arrangement is constructed so that the distance between the second guide roller 13 and the third guide roller 14 corresponds approximately to the length of the flap in the transport direction. As will be seen from FIG. 1, as a result of this feature, the rear end 23 of the flap will swing outwards from the belt 2 when the forward edge of the flap 20 begins to bend around the guide roller 14, or prior to bending around said roller 14, or subsequent to having begun to bend around said guide roller 14.

In order to ensure that this function is achieved, the angle V2 defined between the belt parts on respective sides of the third guide roller 14 is about 150° to 30°, preferably about 90°.

Furthermore, the angle V1 between the belt parts on respective sides of the second guide roller 13 is about 150° to 30°, preferably about 90°.

For the purpose of ensuring that the forward edge of a banknote is inserted between the flap and the belt and therewith achieve smooth infeed of the banknote, as illustrated in FIG. 1, it is essential that the flap and the belt define an adequate angle therebetween. Consequently, it is preferred that the belt parts on respective sides of the first guide roller 10 define an angle V3 of about 0° to 90°, preferably about 30°.

The guide rollers or guide-roller assemblies can be replaced with stationary rods or like elements over which the belt or belts are guided. Thus, the term guide roller used in the following claims will also include rods or like elements.

The belt and the flaps 20, 21 are made from a material which is sufficiently rigid to achieve the aforesaid effect. According to one preferred embodiment of the invention, the belt and flaps comprise a sufficiently-rigid material which will generate relatively low friction against the sheet-like object, preferably a Teflon-coated fibre-glass fabric.

Located adjacent the infeed aperture in the proximity of the first guide roller 10 is a pressure roller 24 which exerts pressure on the belt and the first guide roller.

Located adjacent the flat part 11 of the belt 2 is a pressure plate 25 or corresponding element having a surface area which corresponds to the surface area of the object 12. The plate 25 is biased into light abutment with the belt by means of a spring arrangement 26, 27.

As the banknotes 12 are stacked one upon the other, the pressure plate 25 is displaced downwards, as shown by the arrow 28, to a lower end-position shown in chain lines in FIG. 1.

The forward edges of the banknotes, as seen in the transport direction, lie against a stop plate 29 or the like.

Figure 2:
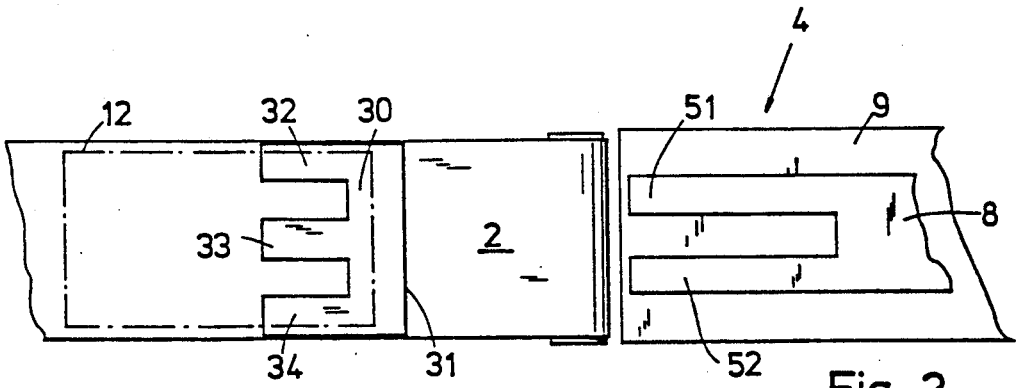
FIGS. 2–4 illustrate different embodiments of an infeed belt, seen from above in FIG. 1.
Figure 3:
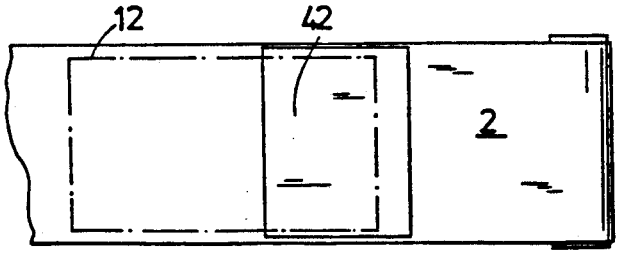
Figure 4:
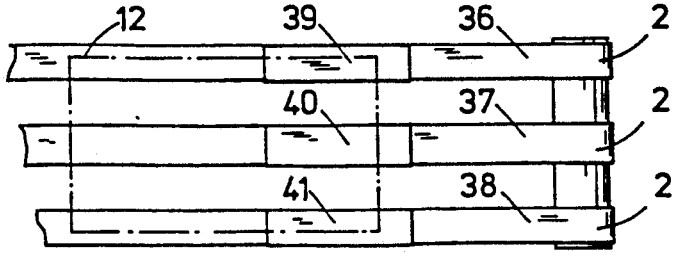
Figure 6:
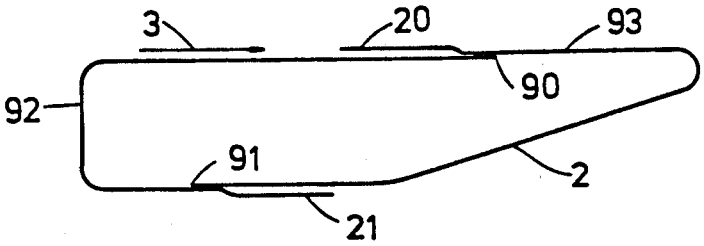
FIG. 6 illustrates a method by means of which a belt can be provided with flaps.

FIGS. 2–4 illustrate mutually different embodiments of flaps and belt, in which the flaps are shown from above in FIG. 1, and hence the belt transport direction is to the right in FIG. 2–4. FIG. 6 illustrates a method of producing an endless belt with two flaps.

In the case of the FIG. 2 embodiment, the flap 30, seen from above, has a forward part 31 which extends across the width of the belt 2 and from which two or more fingers 32, 33, 34 extend in a direction opposite to the transport direction.

It is essential that the two outer fingers 32, 34 cover those edges of a banknote which extend parallel with the transport direction. In the illustrations shown in FIG. 2–4, the position of a banknote in relation to the belt 2 and the flaps is indicated in chain lines. It should be mentioned, however, that a banknote is never transported along the upper part or run 35 of the belt.

FIG. 4 illustrates an embodiment in which the path 1 comprises three mutually parallel belts 36, 37, 38, each provided with respective flaps 39, 40, 41. The path 1 may also comprise two mutually parallel belts or more than three belts.

When more than two belts are used, two or more of the belts may be provided with a respective flap.

FIG. 3 illustrates a simplified embodiment, in which the flap 42 has no fingers.

It is preferred, however, to provide the flap with fingers, such as the fingers 32, 34 illustrated in FIG. 2. A flap of this construction affords an advantage when configuring the infeed passage 7.

FIG. 6 illustrates a method of producing an endless belt 2 having two flaps 20, 21. In the illustrated case, those ends 90, 91 of two belts 92, 93 which are not intended to form a flap are attached to the inside of respective belts in a manner to form the flaps 20, 21. Respective flaps and their junction with respective belts will therefore form an integral unit. It will be understood that if the flaps were to be attached directly to the outer surface of an endless belt, the join between flap and belt would be liable to catch against the edge of the last banknote facing the infeed aperture during an infeed operation, therewith interfering with the infeed of said banknotes.

In accordance with one preferred embodiment, there is provided between the slot-like opening 5 and the first guide roller 10 a guide-slot defined by two mutually parallel plates 8, 9, of which the top plate 8 includes parallel fingers 51, 52, as illustrated in FIG. 2. The bottom plate 9 is whole.

The fingers 51, 52 of the top plate 8 extend parallel with the transport direction and are positioned so that the fingers 32–34 on the flaps can pass between the fingers 51, 52 on said plate.

In the case of the embodiment illustrated in FIG. 4, the fingers of the plate 8 are positioned in a corresponding manner, i.e. between adjacent ones of the three flaps 39, 40 and 41 on the three belts.

In the case of this embodiment, the flap or flaps will lie against the bottom plate 9 when the forward edge of the plate 9 is located adjacent the point at which the flap or flaps join the belt 2 or belts, while the top plate 8 may have a length extension equal to the length extension of the bottom plate 9.

FIG. 1 illustrates the belt in a starting position, in which the belt is stationary. Means are provided for stopping the belt in this position, and also for stopping the belt in the position in which the flap is located in the position in which the flap 21 is located. The belt is thus stopped twice with each revolution of the belt, when the belt is provided with two flaps 20, 21, as in FIG. 1. These means may comprise a first photo-cell comprising a photo-diode 60 and a photo-transistor 61, the beam path of the photo-cell being broken when a flap 21 is located on the bottom plate 9.

The arrangement also includes a second photo-cell comprising a photo-diode 62 and a photo-transistor 63, the beam path of which is located adjacent the first guide roller 10, said beam path being broken when a banknote 12 has been inserted to a sufficient extent in between the belt 2 and the flap 21. A suitable distance between the forward edge of the banknote and the junction between flap and belt is 10–15 mm.

When this beam path is broken, a signal is sent, with the aid of suitable, known means, to a drive motor for starting the belt. The drive motor then rotates the belt 2 until the flap 20 reaches the position occupied by the flap 21 in FIG. 1, whereafter the procedure is repeated and the next banknote is inserted, and so on.

The arrangement may also be provided with a third photo-cell comprising a photo-diode 64 and a photo-transistor 65, the beam path of which is located in the close proximity of the slot-like opening 5. In this case, two drive rollers or drive-roller assemblies 66, 67 are provided, the drive motors of which are started when the beam path of the third photo-cell is broken. This drive is stopped suitably a short time after the pulse occurring when the banknote fed-in by means of the drive roller 66, 67 open the beam path of the second photo-cell, which takes place when the rear edge of the banknote passes the beam path of the third photo-cell.

The infeed-control circuit for controlling the aforedescribed procedure may be of any known kind and will not therefore be described in detail here.

The modus operandi of the infeed arrangement is as follows:

The belt is in its starting position, as illustrated in FIG. 1. A banknote 12 is then inserted through the slot-like opening 5 until the banknote breaks the beam path of the third photo-cell 64, 65, whereupon the drive rollers 66, 67 are activated to advance the banknote 12 until the leading edge of said banknote breaks the beam path of the second photo-cell 62, 63. The belt is therewith started and moves in the direction of the arrow 3, so as to draw the banknote in between the first guide roller 10 and the pressure roller 24, with the forward edge of the banknote lying between the belt and the flap, as illustrated in FIG. 5*a*.

Figure 5A:
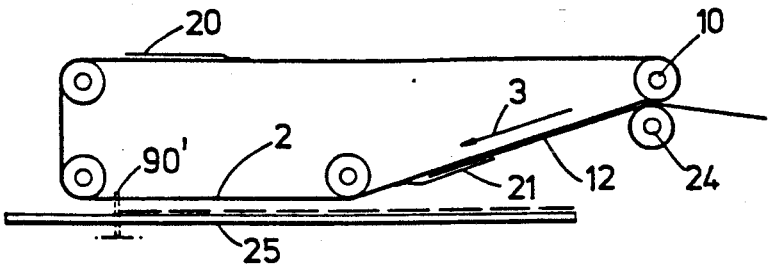
FIGS. 5*a*–5*c* illustrate the modus operandi of the arrangement starting from the position illustrated in FIG. 1.
Figure 5B:
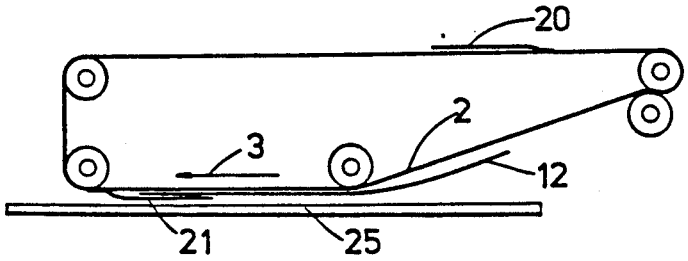
Figure 5C:
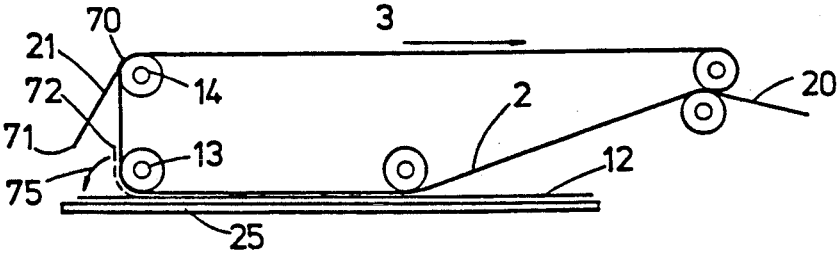

For the sake of clarity, FIG. 5*a*–5*c* illustrate the belt, the flap and the banknote slightly separated from one another.

When the flap 21 reaches the pressure plate 25, or the uppermost banknote on said pressure plate when banknotes have already been deposited on said plate, the flap presses against the banknote so as to clamp the banknote firmly between the flap and the belt.

Because the banknote is clamped firmly at its forward edge part, the banknote is drawn-in instead of being pushed-in, as illustrated in FIG. 5*b*.

As will be understood from the aforegoing, the flap 21 protects the forward edge-part of the banknote and also part of those edges of the banknote which extend parallel with the transport direction.

Consequently, the fact that a banknote may be torn in these regions or the fact that tears may be present on the immediately underlying banknote over which said banknote is fed, will have no significance on the efficient infeed of said banknotes.

Furthermore, the presence of tears on the immediately underlying banknote, or on the unprotected part of the edges of the banknote being fed-in by the arrangement will not result in crinkling of the lower banknote (as hereinbefore defined) because the banknote being fed into the arrangement is drawn-in by its forward edge. Furthermore, passage of the flap over the uppermost banknote in the stack will flatten-out the edges of any tears that may be present.

The arrangement according to the present invention has been found to operate effectively, without the occurrence of the problems mentioned in the introduction, even when the banknotes concerned are damaged.

The belt 2 continues to move in the transport direction, wherewith the rear edge 71 of the flap leaves the space between the belt and the uppermost banknote in the stack, or the pressure plate when no banknotes have previously been fed into said space. The rear edge 71 of the flap leaves said space when the junction 70 of the flap with the belt reaches the third drive roller 14, or prior to said junction reaching said roller.

Thus, the forward edge 72 of the banknote is drawn up to a position between the second guide roller 13 and the third guide roller 14, as shown in a broken line in FIG. 5*c*.

When the rear edge 71 of the flap moves free of the flat space under the lower stretch of belt 2, it will spring-out to the position illustrated in FIG. 5*c*, whereupon the forward edge-part 72 of the banknote will fall down in the manner illustrated by the arrow 75.

This outward springing of the flap 21 is accentuated when the junction 70 passes the curve formed by the third guide roller 14.

The belt 2 of the illustrated embodiment is then stopped, due to the second flap 20 having reached a position in the infeed passage where it breaks the beam path of the first photo-cell 62, 63, i.e. has reached the starting position.

When the next banknote is fed-in, the preceding banknote will be advanced slightly by means of friction against the belt, until the forward edge of the banknote reaches the stop plate 29.

The stop plate can be replaced with upstanding pins or some other appropriate stop devices.

The described cycle is repeated, with the pressure plate 25 being moved downwards as the number of banknotes carried thereby increases, until the plate reaches its lower limit position, which is detected by a microswitch 76 or some other appropriate sensor. When the pressure plate reaches this position, the drive to the roller 66, 67 and the belt is stopped. This situation is suitably indicated optically, with the aid of a photodiode for instance, therewith indicating that the banknote magazine is full.

Figure 7:
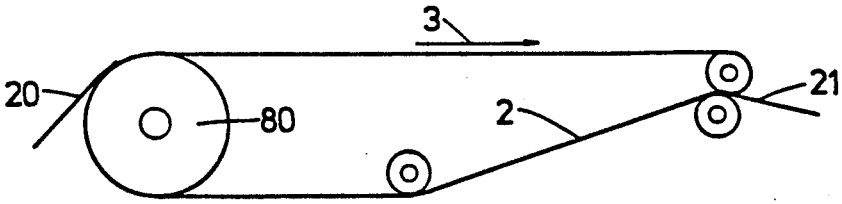
FIG. 7 illustrates schematically and in side view a second embodiment of the inventive arrangement.

FIG. 7 illustrates schematically a second embodiment of the invention, in which the curved-part of the infeed path comprises a roller or roller-assembly 80 having a radius which corresponds approximately to the length dimension of the flaps 20, 21 in the transport direction. In other respects, this embodiment is similar to the first embodiment described above.

As before mentioned, as was described with reference to FIG. 5*c*, the forward edge 72 of the banknote enters the curved part of the infeed path before the rear edge of the flap leaves the space between the belt and the pressure plate, i.e. the flat part of the infeed path. The forward edge of the banknote falls down when the flap swings out.

Alternatively, stop hooks 90 or stop pins can be positioned upstream of the curved part, in the transport direction, as illustrated in broken lines in FIG. 5*a*.

When more than two belts are used, hooks 90 are provided in the space between the belts. When only one belt is used, a slot for each hook 90 can be formed along a given length of the belt, extending from the junction of the flap with the belt and rearwardly in the transport direction, and by resiliently mounting the hooks so that as the slot passes the hooks will spring up from the depressed position shown in FIG. 5*a* and protrude through the slot, and will be again depressed when the slot has passed.

When such stop hooks are used, or any other type of stop hooks, the intention is that the forward edge of the banknote will abut the hooks and be restrained thereby as the belt continues to move. This will result in the forward part of the banknote being withdrawn from the space between the flap and the belt.

FIG. 5*a* illustrates in broken lines a banknote 91 which has been stopped and moved-in by means of the flap 20.

Figure 8:
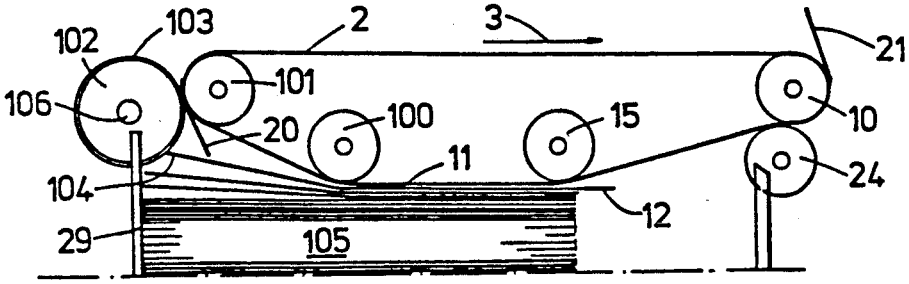
FIG. 8 is a side view of an inventive arrangement constructed in accordance with a third preferred embodiment.

According to one especially preferred embodiment shown in FIG. 8, one or more rotatable wheels 102 are located adjacent the curved part of the infeed path, each such wheel 102 being positioned so that its periphery 103 will lie close to but outside the infeed path 1. The wheels 102 are rotated in a direction opposite to the transport direction of the path 1. The wheel or wheels 102 has, or have, an irregular periphery, such as a toothed periphery.

Thus, a conventional cog wheel can be used. The wheel or wheels, however, may also comprise a hub carrying a radially projecting brush or like device. The wheel or wheels is, or are, intended to feed down the forward edge of a banknote when the banknote is separated from the flap, as illustrated by the forward edge 104 of the uppermost banknote in the FIG. 8 illustration.

The reference 105 in FIG. 8 indicates a stack of banknotes fed-in by means of the arrangement.

The provision of the wheel or wheels 102 ensures that banknotes will not be fed past the banknote-depositing location by the belt and back to the infeed aperture.

The wheel, or in the case of the illustrated embodiment wheels is, or are, carried by a shaft 106 which is driven by an electric motor (not shown). According to one embodiment, the wheel may have a width corresponding to the whole of the width of the infeed path, or a part of said width. When the infeed path has the configuration illustrated in FIG. 2 or 4, two wheels are preferably used, said wheels being positioned opposite the space between the fingers 32–34 and between the belts 36–38.

It will be obvious from the aforegoing that the present invention solves the problems mentioned in the introduction.

The illustrated arrangement can, however, be modified. For instance, the infeed path 1 can have a configuration different to that illustrated in the accompanying drawings. Furthermore, the banknote magazine and the infeed passage may also have a configuration different to that illustrated.

It will therefore be understood that the invention is not restricted to the afore-described exemplifying embodiments, and that modifications can be made within the scope of the following claims.

I claim:

1. An infeed arrangement, in combination with a collection space, for feeding sheet-like objects having front, rear and side edges, into said collection space in which the sheet-like objects are stacked in parallel disposition, one on top of each other, said infeed arrangement including an infeed aperture means, with inlet and outlet, wherein the objects are fed into said inlet, through said infeed aperture means and thence through said outlet to said collection space from an external location, and wherein said infeed arrangement further comprises at least one endless belt (2) including means for driving said belt in one direction, and a first belt guide means, said belt having a flat stretch of run and a run portion arranged over said first guide means to pass by the outlet of the infeed aperture means (5, 7), said flat stretch run of said belt being mounted so it is disposed above said collection space and parallel with the parallel planes of said sheet-like objects when deposited in a stack in said collection space, said infeed arrangement (1) includes a further run of said belt and a second belt guide means downstream of said flat stretch run of said belt, which further run is curved over said second belt guide means so that the endless belt path turns back towards the outlet of said infeed aperture means (5, 7); said endless belt (2) being provided with at least one flap means (20, 21; 30; 39–41; 42) directed rearwardly relative to the direction of movement of said belt and said flap means having a forward edge portion which secures said flap means to said belt and provides an offset of the remaining portion of said flap means which is offset outwards from the outwardly facing side of the belt (2), said flap means (20, 21; 30; 39–41; 42) having a length dimension in the direction of movement of said belt which is shorter than the length dimension between said front and rear edges of a said sheet-like object (12), said sheet-like object, during an infeed operation being inserted into the inlet of said infeed aperture means (5) and the front edge of a said sheet-like object, relative to the direction of movement of said belt, being moved to and located between the flap means (20, 21; 30; 39–41; 42) and the outer surface of said endless belt (2); and said curved further run of the endless belt is configured so that the rear edge of the flap means will swing out from the endless belt surface when said rear edge of the flap means passes the second belt guide means.

2. An infeed arrangement according to claim 1, wherein the length of the flap means (20, 21; 30; 39–41; 42) is a dimension in the range of from one-third to one-half of the length of a said sheet-like object (12) between its front and rear edges.

3. An infeed arrangement according to claim 1, wherein said first guide means for said endless belt is located adjacent said outlet of said infeed aperture means, and said belt, as it moves over said second guide means (13), forms an angle (V1) with the flat stretch run of said belt, and a third guide means spaced at a distance from said second guide means (13; 100) is provided, over which said endless belt passes and moves towards the outlet of said infeed aperture means (5, 7), whereby the second guide means (13; 100) and the third guide means (14; 101) form said curved further run part; the distance dimension between the second guide means (13; 100) and the third guide means (14; 101) is essentially equal to the length dimension of the flap means (20, 21; 30; 39–41; 42).

4. An infeed arrangement according to claim 3, wherein the angle formed by portions of the belt before and after said third guide means is in the range of from 150° to 30°.

5. An infeed arrangement according to claim 4, wherein the angle formed by portions of the belt before and after said second guide means is in the range of from 150° to 30°.

6. An infeed arrangement as defined in claim 4, wherein said angle is substantially 90°.

7. An infeed arrangement according to claim 1, wherein the angle formed by portions of the belt before and after said first guide means is in the range of from 0° to 90°.

8. An infeed arrangement as defined in claim 7, wherein said angle is substantially 30°.

9. An infeed arrangement according to claim 1, wherein said second guide means over which the curved part of the further run of the endless belt moves, and comprises at least one roller (80) having a radius which corresponds approximately to said length dimension of said flap (20, 21; 30; 39–41; 42).

10. An infeed arrangement according to claim 1, wherein at least one rotatable wheel (102) is arranged adjacent the curved further run of said endless belt and is disposed and positioned so that its periphery lies closely adjacent but outside said curved part of the endless belt (1); and power means drive said at least one wheel in a direction opposite to the direction of movement of said endless belt.

11. An infeed arrangement according to claim 10, wherein said at least one wheel (102) has an irregular periphery.

12. An infeed arrangement as defined in claim 11, wherein said irregular periphery is a toothed periphery.

13. An infeed arrangement according to claim 1, wherein said at least one endless belt comprises a plurality of mutually parallel, spaced-apart endless belts (36–38).

14. An infeed arrangement according to claim 13, wherein at least two of the plurality of endless belts (36–38) are provided with said flap means (39–41).

15. An infeed arrangement according to claim 14, wherein the outlet portion of said infeed aperture means (5) adjacent said first guide means (10) comprises a guide slot means defined by two mutually parallel top and bottom plates (8, 9) for guiding a sheet-like object fed into the infeed arrangement, of which plates the top plate (8) includes parallel fingers (51, 52) which extend parallel with the direction of movement of the plurality of spaced-apart endless belts; and wherein said plate fingers (51, 52) are positioned so that said flap means (32–34; 39–41) on said plurality of spaced-apart endless belts are able to pass between said plate fingers (51, 52).

16. An infeed arrangement according to claim 1, wherein said flap means (30) has a forward portion (31) including said forward edge, which extends laterally over the belt and from which at least two fingers (32–34) project in a direction opposite to the direction of movement of said endless belt.

17. An infeed arrangement according to claim 1, wherein said at least one endless belt (2) and said flap means (20, 31; 30; 39–41; 42) comprise a material which will generate relatively low friction against a said sheet-like object.

18. An infeed arrangement as defined in claim 17, wherein said material is a teflon-coated fibre-glass fabric.

19. An infeed arrangement according to claim 1, wherein said collection space includes a spring biased flat pressure plate mounted adjacent and parallel with said flat stretch run (11) of the endless belt, said pressure plate (25) having a surface area which corresponds in size to the surface area of a said sheet-like object (12) and which pressure plate is lightly biased into abutment with the belt (2).

20. An infeed arrangement according to claim 1, wherein a pressure roller (24) is mounted adjacent said first guide means (10) and adjacent the outer surface of said endless belt for exerting pressure on the endless belt (12) and against said first guide means (10).

* * * * *